United States Patent [19]

Hammann

[11] 4,154,540

[45] May 15, 1979

[54] DRIVE FOR MIXING MACHINE

[75] Inventor: Heinz Hammann, Neustadt, Fed. Rep. of Germany

[73] Assignee: IBAG-Vertrieb GmbH, Neustadt, Fed. Rep. of Germany

[21] Appl. No.: 931,187

[22] Filed: Aug. 4, 1978

[30] Foreign Application Priority Data

Aug. 24, 1977 [DE] Fed. Rep. of Germany ..... 2738123

[51] Int. Cl.[2] ..... B01F 7/18

[52] U.S. Cl. ..... 366/296

[58] Field of Search ..... 366/295, 293, 294, 296, 366/287, 288, 300, 279, 342, 343, 64, 65, 66

[56] References Cited

U.S. PATENT DOCUMENTS

| | | | |
|---|---|---|---|
| 528,175 | 10/1894 | Markus | 366/296 |
| 1,113,123 | 10/1914 | Innes | 366/296 |
| 1,486,577 | 3/1924 | Hapgood | 366/296 |
| 1,997,035 | 4/1935 | Arbuckle | 366/296 |

*Primary Examiner*—Robert W. Jenkins

*Attorney, Agent, or Firm*—Orville N. Greene; Frank L. Durr

[57] ABSTRACT

In a mixing machine which has three sets of mixing blades, disk means for driving the sets one above the other, and all said disk means adapted to rotate about a vertical shaft in horizontal planes and to be driven by a single motor and wherein the disk of the middle set of blades is constructed to rotate in the opposite direction to the other two, a drive comprising a gearing unit protected by cover means is provided which is adapted to drive all the sets of blades from said vertical shaft. Said drive means comprising, gearing, disk means, cover, etc., is combined into a single unit so that it can be replaced as a unit.

2 Claims, 1 Drawing Figure

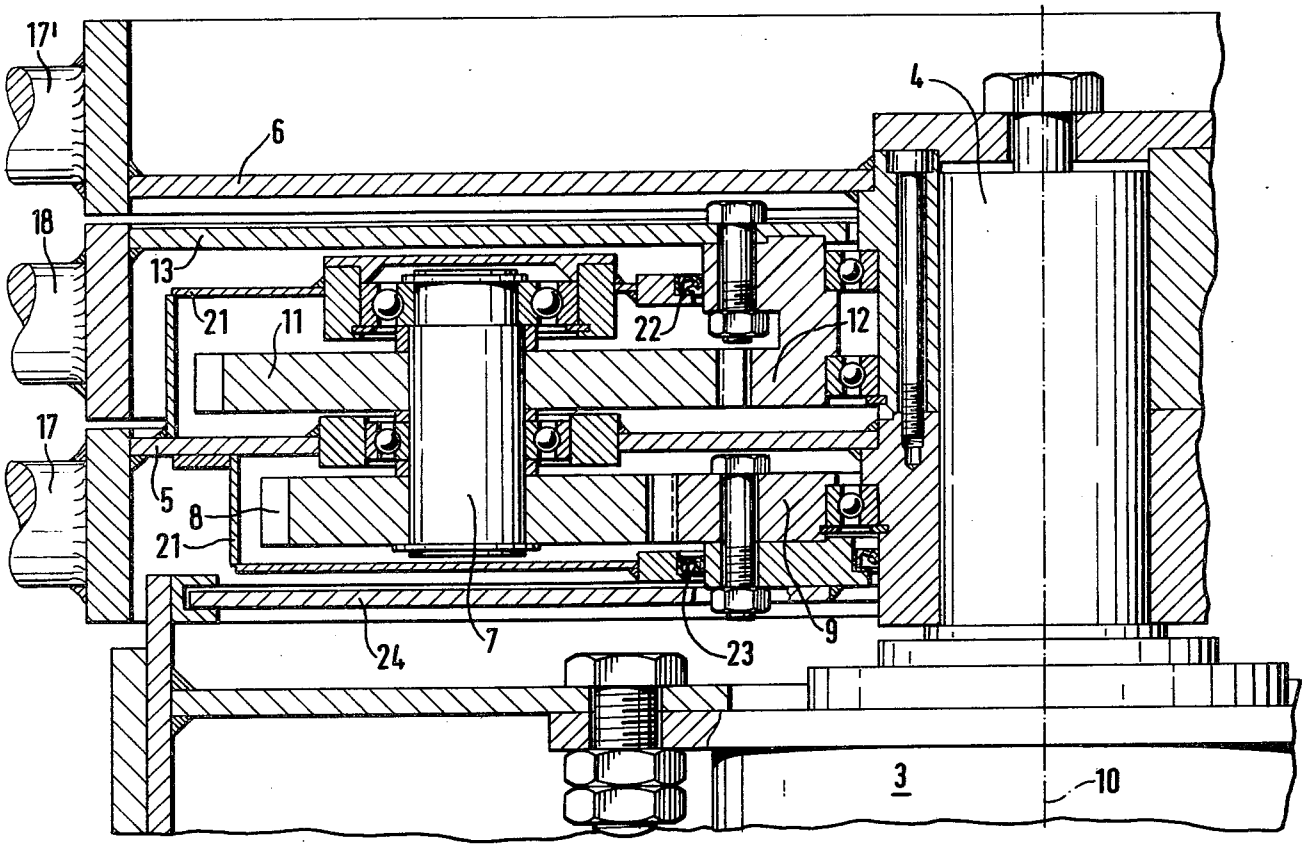
4
12
22
6
13
17'
18
17
11
21
5
8
21
7
9
23
24
3
10

DRIVE FOR MIXING MACHINE

The invention relates to a drive for a mixing machine of the type having a stationery mixing bowl with an annularly shaped mixing cavity bounded by the bottom, inner and outer walls, with discharge for the mixture which may be structural material, fluids and the like, in which two synchronously rotating sets or groups of implements and an additional set of mixing implements so arranged with respect to one another that the mixing implements of the last named implement set is spaced from the other two (e.g., above the overlap range when the implements of the first two sets are constructed to intermesh) and are operable in opposing direction to first sets around the generally vertical middle axis. The operation of the sets of mixing implements is generally accomplished by means of two motors through interposed gears and pinions.

Through an arrangement of mixing implements of this type, the rotating of the mixture with the implements is almost eliminated, and accordingly, the sought for homogenization of the mixture is accelerated.

With this type of mixing machine there can also be provided a single central vertically arranged driving motor and for operation of both oppositely rotating sets of mixing implements, a direct connection of the drive shaft of the operating motor with the sets of mixing implements is provided and a a shaft can be positioned in one of the drive wheels of the direct driven mixing implement which shaft carries two gears, of which one meshes with the gear connected with the drive shaft of the motor and the other meshes with the gear connected with the drive wheel of the second set of mixing implements. Such mixing machines are shown in Ger. Offenlegenschrifts Nos. 2,603,057 and 2,607,932.

These proposals, which simplify the driving, still however neglect the fact that the several gears which mesh with one another in the mixing of construction materials, for example, are exposed to intense abrasion under the usual harsh operating conditions.

The present invention, accordingly, is based on the problem of providing at the outset, drive means for a machine of the type described wherein the different operating parts for transmission of the oppositely rotating driving forces are so arranged that good and air tight protection against the inflow, especially of powder, is obtained during operation.

The invention solves these problems connected, for example, with a mixing machine of the type, disclosed in Ger. Offen. Nos. 2,603,057 and 2,607,932 and having a central and vertically arranged drive motor with a drive shaft directly connected to two drive disks for the first two mixing implement sets, and these two driving disks surround the disk for driving the counter-rotating set of mixing implements, wherein, in addition, in the lower drive disk for one of the first set of mixing implements, a shaft is supported which carries two gears, one of which meshes with a fixed gear arranged coaxially on the drive shaft and the other of which meshes with a similar gear coaxial to the drive shaft fixed on the drive disk for the second set of mixing implements whereby furthermore a cover connected with the lower drive disk for the first set of mixing implements is provided to enclose the total pinion arrangement, wherein finally the requisite annular slot between the cover and the other parts which move relatively to the cover is provided with a suitable packing.

Besides, the whole gear arrangement can also be replaced as a complete plug-in unit.

In such a manner, it is guaranteed that by a breakdown of any part of this gear arrangement, it can be exchanged in its entirety quickly and simply in order to keep the idle time of the mixing machine as short as possible.

In the following description, an embodiment thereof, shown schematically and by way of example in the single FIGURE of the drawing, will be further explained.

A drive motor 3 with a drive shaft 4, projecting from above, which is the drive shaft for the entire mixing arrangement, is secured with its middle axis 10 coaxial to the middle axis of the mixing space of a mixing machine. The shaft 4 carries a drive disk 5 and a drive disk 6 which are connected to rotate with the rotatable shaft 4. The drive disks 5 and 6 carry mixing implement arms 17 and 17' on whose free ends corresponding mixing tools, which rotate in the mixing region, are arranged.

Between the two drive disks 5 and 6, a further drive disk 13 is provided for counter-rotating mixing implements to which mixing implement arms 18 are fastened.

In order to produce this counter-rotation, a shaft 7 is supported in the driving disk 5 which carries a pinion 8 on its lower end and a pinion 11 on its upper end. The pinion 8 meshes with a fixed ring gear 9 coaxial to shaft 4. The pinion 11 meshes similarly with a ring gear 12 coaxial to shaft 4 and attached to disk 13.

The whole pinion arrangement is enclosed by means of a covering 21 in which the shaft 4 likewise rests and which is connected rigidly and air tight with the drive disk 5. The requisite ring opening between the cover 21 and the other operating parts which move relative thereto are safeguarded with "Simmering" packing or similar suitable packing 22 and 23.

The whole arrangement is mounted on a holding plate 24 which in turn is fastened in the mixing space of the mixing machine. The whole thing forms in such manner a light and simple exchangeable complete affixable unit.

I claim:

1. In a driving means for a mixing machine of the type having a stationery mixing bowl with an annularly shaped mixing cavity wherein upper and lower disks for driving two sets of synchronously rotating mixing implements are provided, a first set of mixing implements being mounted on said upper driving disk and a second set of mixing implements being mounted on said lower driving disk, each disk being mounted for rotation in a horizontal plane about a vertical axis, and an additional set of mixing implements mounted on an intermediate driving disk for rotation about the said vertical axis in the opposite direction to the first and second sets, the improvement comprising a central and vertically arranged drive motor connected to a first drive shaft to which the driving disks of said two synchronous groups are directly attached, the lowermost of said driving disks having a second shaft rotatably mounted therein, said second shaft containing gear means mounted thereon below the lowermost disk and gear means therein mounted above said lowermost disk, a stationery gear means mounted concentrically of first drive shaft so as to mesh with that gear means of the second shaft which is below the lower driving disk gear means affixed to the driving disk of said intermediate group of implements meshing with the uppermost gear of said secondary shaft, and casing means attached to said lowermost driving disk and enclosing the gearing associated with said second shaft, and slots between the casing and the other parts which move with respect to it being fitted with a suitable packing.

2. The drive for a mixing machine as claimed in claim 1 wherein said total gear arrangement is a completely replaceable unit.

* * * * *